United States Patent [19]

Martin

[11] 4,125,047

[45] Nov. 14, 1978

[54] CUTTER WIRE AND CUSHION BLOCK ASSEMBLY FOR A BRICK-CUTTING MACHINE

[75] Inventor: William R. Martin, Wadsworth, Ohio

[73] Assignee: General Wadsworth Brick Corp., Columbus, Ohio

[21] Appl. No.: 844,890

[22] Filed: Oct. 25, 1977

[51] Int. Cl.[2] ..... B28B 11/14

[52] U.S. Cl. ..... 83/581.1; 83/595; 83/651.1

[58] Field of Search ..... 83/581.1, 594, 595, 83/651.1, 307.1, 307.2, 307.3

[56] References Cited

U.S. PATENT DOCUMENTS

| | | | |
|---|---|---|---|
| 711,896 | 10/1902 | Hix | 83/307.3 |
| 1,555,769 | 9/1925 | Steele | 83/651.1 |

*Primary Examiner*—J. M. Meister

*Attorney, Agent, or Firm*—William S. Rambo

[57] ABSTRACT

A brick-cutting machine having an axially rotating reel with sets of radially disposed, spring-tensioned cutting wires is equipped with resiliently compressible, rubber cushion blocks or pads positioned to cushion and limit rebounding movement of the wire-tensioning springs and thereby prevent the application of excessive and destructive tension forces to the cutting wires of the reel.

2 Claims, 5 Drawing Figures

CUTTER WIRE AND CUSHION BLOCK ASSEMBLY FOR A BRICK-CUTTING MACHINE

BACKGROUND OF THE INVENTION

This invention relates generally to brick-cutting machines of the type which include an axially rotating reel having a multiplicity of spring-tensioned, radially positioned cutting wires operable upon rotation of the reel to sever and divide a rectangular column of clay transversely into a number of brick-forming modules. More specifically, this invention deals with an improved cutter wire and cushion block assembly for a rotating reel-type brick-cutting machine.

In the past, brick-cutting machines have been widely employed in brick making plants for the purpose of cutting and dividing an extruded, "green" (unfired) clay column into individual brick-forming modules preparatory to firing in a kiln. Such machines commonly include an open-ended reel through which a continuous, extruded column of "green" clay is conveyed for cutting. The reel of such machines usually includes plural sets or rows of radially disposed, axially spaced, cutting wires which are individually carried in tension between an axially rotatable, inner hub plate and a radially outwardly positioned bow spring carried on an axially extending support bar of the reel. As the reel rotates, the cutting wires pass transversely through the column of clay to cut in into a row of separated brick-forming modules. During passage of the cutting wires through the clay column, the wire-tensioning springs flex inwardly to permit the wires to bow slightly under the shear forces applied thereto by the clay column. However, when the wires break free of the clay column, the tensioning springs tend to snap or rebound outwardly and apply a sudden jerk and overtension to the wires which often results in their breakage. Wire breakage and replacement accounts for considerable down time in such machines, and adds materially to the costs of producing bricks.

SUMMARY AND OBJECTS OF THE INVENTION

According to this invention, each of the wire-tensioning springs of the cutting reel of the machine is provided with a cushion block or pad of resiliently compressible material (vulcanized rubber) which is arranged to limit rebounding movement of the spring and sudden overtensioning of the associated cutting wire as the latter passes through and free of the clay column.

The principal object of this invention is to reduce breakage and increase the working life of the cutting wires of a rotary reel-type brick-cutting machine by installing a structurally simple cushion pad or block adjacent each wire-tensioning spring and in a position to limit or cushion the rebounding movement of the spring and thereby prevent inertial overtensioning of the associated cutting wire.

Additional objects and advantages of the invention will become more apparent by reference to the following description and the accompanying drawings.

DESCRIPTION OF PREFERRED EMBODIMENT OF THE INVENTION

Figure 1:
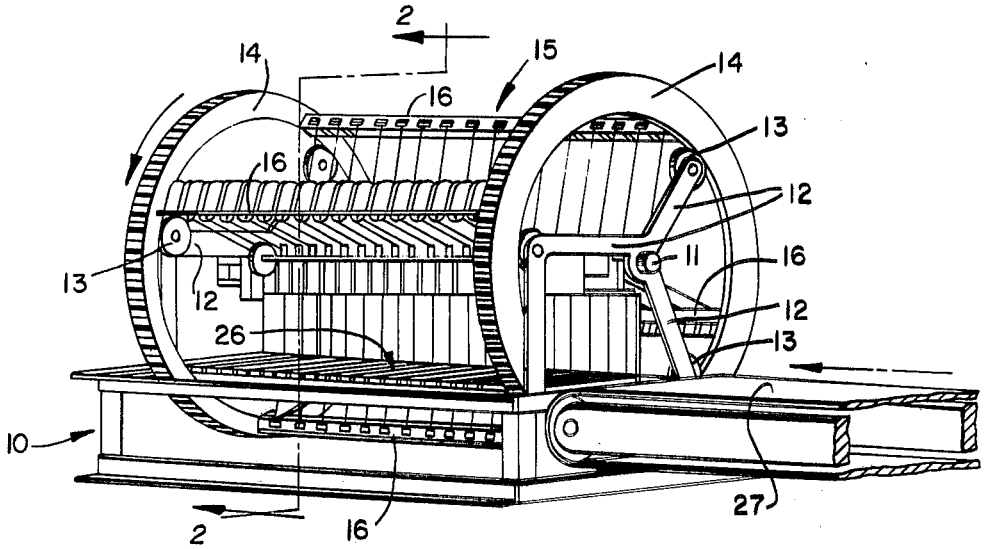
FIG. 1 is a small scale, fragmentary perspective view showing certain of the essential elements of a brick-cutting machine to which the present invention is applicable.
Figure 2:
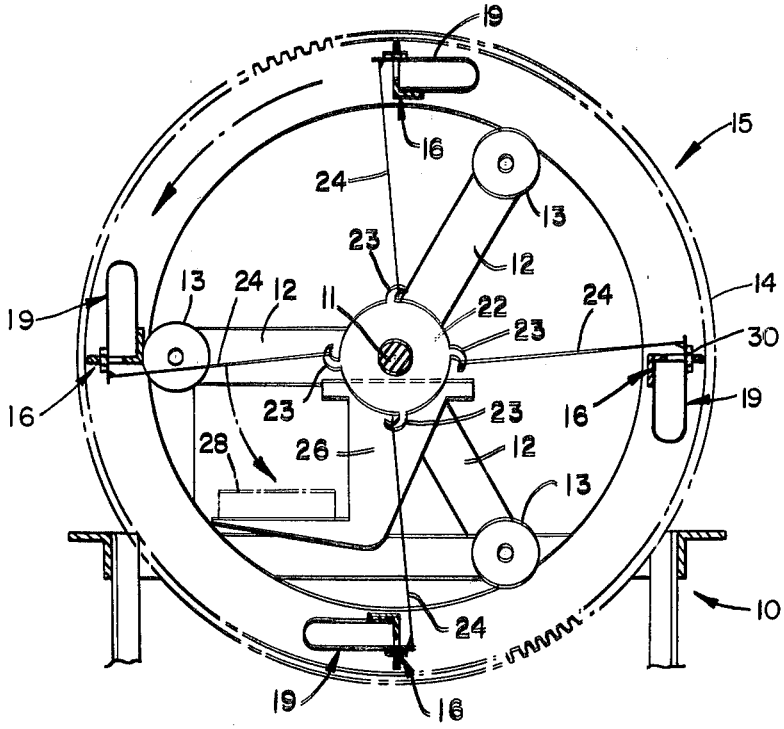
FIG. 2 is an enlarged, transverse vertical sectional view taken through the machine approximately along a plane indicated by the line 2—2 of FIG. 1.

With reference to the drawings, FIGS. 1 and 2 illustrate the essential components of a conventional brick-cutting machine to which the present invention is applicable. The brick-cutting machine comprises a bed or base frame 10 above which is mounted a relatively stationary, axially extending axle shaft 11. Connected with each end of the axle shaft 11 are a set of triangularly related, radially outwardly extending spider arms 12. Journaled for rotation on the end of each of the spider arms 12 is a circumferentially grooved guide roller 13. The guide rollers 13 rotatably support a pair of ring gears 14 which define, respectively, the open ends of an axially rotatable reel, generally designated by the reference numeral 15. In addition to the ring gears 14, the reel 15 includes four outer support bars 16 which extend axially of the reel 15, and which are connected in circumferentially spaced relation to the inner side surfaces of the ring gears 14.

Figure 4:
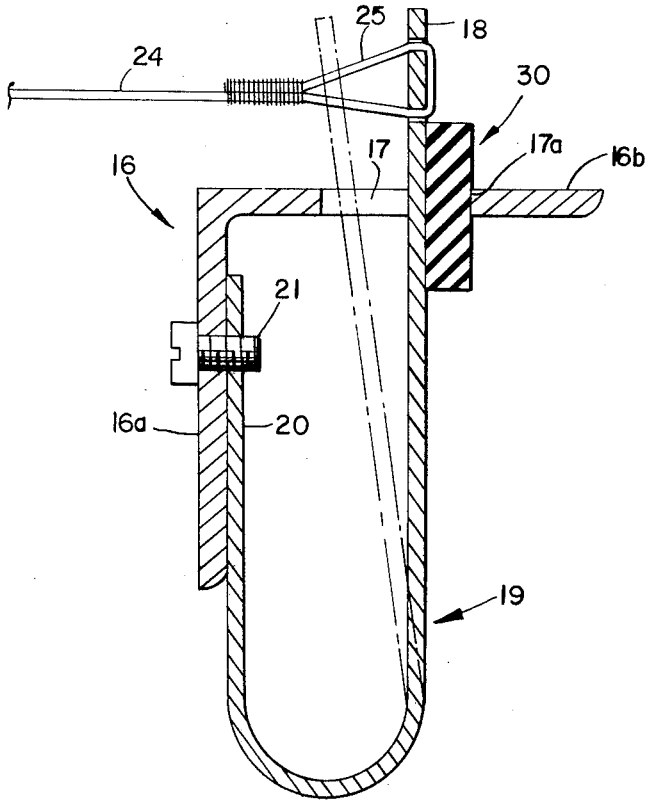
FIG. 4 is an enlarged vertical sectional view taken through one of the wire tensioning spring assemblies approximately along the line 4—4 of FIG. 3.
Figure 3:
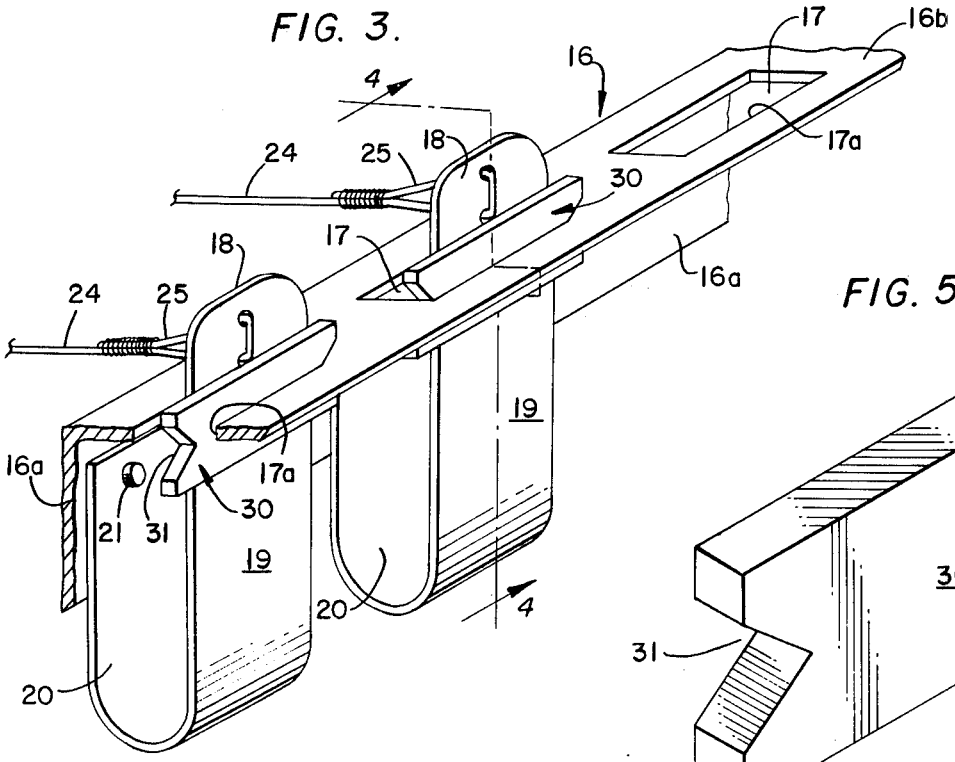
FIG. 3 is a fragmentary perspective view of one of the angle iron support bars of the reel and showing the cushion blocks of the present invention positioned adjacent the free ends of the wire-tensioning springs.

As shown more particularly in FIGS. 3 and 4, each of the outer support bars 16 of the reel comprises an angle iron formed with perpendicularly related, longitudinally extending webs 16*a* and 16*b*. Each of the outer support bars 16 is welded, or otherwise suitably, rigidly secured at its respective ends to the inner side walls of the ring gears 14, so as to provide a unitary and axially rotatable reel structure. The webs 16*b* of each outer support bar 16 are formed at longitudinally spaced intervals with rectangular slots or apertures 17 through which extend the resiliently flexible, free end portions 18 of a like number of generally U-shaped bow springs 19. As shown in FIG. 4, the opposite leg portion 20 of each of the bow springs 19 is securely fastened to the leg or web 16*a* of the outer support bar 16, as by means of rivets or bolts 21.

The reel 15 further includes a multiplicity of inner hub plates or disks 22 (see FIG. 2) which are rotatably journaled in relatively axially spaced apart relation on the axle shaft 11. Each of the inner hub plates or disks 22 is disposed in the radial plane of one of the spring-receiving slots 17 of the outer support bars 16, and each hub plate 22 is formed on its periphery with four, outwardly projecting, hook-like fingers 23.

Extending radially between each of the hook-like fingers 23 of the hub plates 22 and the free end portion 18 of each of the bow springs 19 is a tensioned cutting wire 24. Each of the cutting wires 24 is formed at its opposite ends with loops 25 to engage, respectively, the free end portion 18 of a bow spring, and the hook-like finger 23 of an inner hub plate 22. The length of the cutting wires 24 is such that they are maintained under tension at all times by the bow springs 19. However, as shown by broken lines in FIG. 4, the widths of the slots 17 permit the free end portions 18 of the bow springs 19 to flex resiliently inwardly toward the axis of the reel in response to shear forces applied to the cutting wires 24 during cutting operations, as will be hereinafter more fully explained.

Mounted on the axle shaft 11 and disposed between the rotatable hub plates 22, are a series of relatively axially spaced, depending, L-shaped platen-forming segments or arms 26 (see FIG. 2). The platen-forming segments 26 are spaced relatively apart by an intervening hub plate 22, and thus define between them a series of radially disposed slots through which the cutting wires 24 may pass during rotation of the reel 15 around the axle shaft 11.

The brick cutting machine also includes a power driven belt conveyor 27 whose discharge end is disposed closely adjacent to and in longitudinal alignment with the horizontal arms of the platen-forming segments 26. In the usual manner, the feed conveyor 27 functions to convey an elongated, extruded, rectangular column of unfired, "green" clay (indicated by numeral 28 in FIG. 2) onto the horizontal arms of the platen-forming segments 26 of the machine, and into position where the column of clay may be transversely cut and divided by the cutting wires 24 of the reel 15 into a plurality of individual, brick-forming modules of predetermined dimensions.

It should be understood that all of the component parts of the brick-cutting machine heretofore described are conventional and, as such, form no part of the present invention aside from their combination with the improved spring-cushioning block or pad to be hereinafter described.

Figure 5:
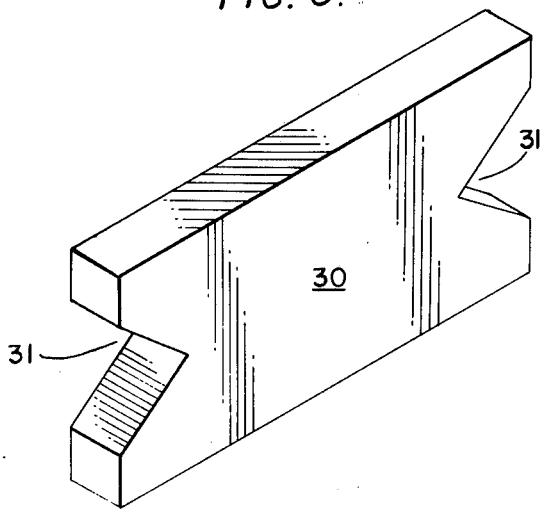
FIG. 5 is a perspective view of a spring cushioning block or pad according to the present invention.

According to this invention, a resiliently compressible cushion block or pad 30 is positioned in each of the slots 17 of the outer support bars 16 of the reel 15, between the outer surface of the free end portion 18 of the bow spring 19 and the wall 17*a* of the slot 17. The position of the cushion block or pad 30 is such that it cushions and limits rebounding movement of the free end portion 18 of the bow spring 19 and prevents rebounding contact of the free end portion 18 with the wall 17*a* of the angle iron bar 16. Each of the cushion blocks or pads 30 preferably comprises a generally rectangular block of vulcanized rubber which is formed at its opposite ends with V-shaped notches or recesses 31 to receive and engage the end walls of the slots 17. As shown in FIGS. 3 and 5, the cushion block or pad 30 is slightly longer than the slot 17, but the cushion block 30 may be resiliently flexed or bent to permit it to be introduced within the slot 17 and maintained therein by engagement of the grooved ends 31 of the block 30 with the adjacent end walls of the slot 17.

OPERATION

In the operation of the brick-cutting machine, the ring gears 14 of the reel 15 are driven in counterclockwise rotation as viewed in FIGS. 1 and 2, by a motor-driven gear transmission (not shown), and the inlet conveyor 27 is operated in synchronism with the reel 15, so as to introduce an extruded column of unfired, "green" clay onto the platen-forming segments 26 immediately following the passage of one of the four sets of cutting wires through the spaces between the segments 26. As the reel 15 continues to rotate, the next set of cutting wires passes transversely through the clay column which is supported on the axially spaced apart, platen-forming segments 26 to divide the column into individual brick-forming cubicles or modules. The inlet conveyor 27 is then reactivated to introduce a successive extruded column of clay onto the platen-forming segments, simultaneously with the removal of the cut brick-forming modules from the segments 26, and the next set of cutting wires then passes through the second column of clay, and so on.

As the cutting wires 24 come into contact with and pass through the column of clay, they are subjected to shear forces which tend to bend or bow the wires slighyly. These shear forces applied to the wires 24 causes the free end portions 18 of the bow springs 19 to flex radially inwardly, as indicated by broken lines in FIG. 4. As soon as the wires 24 complete their cutting passage through the column of clay, and break free of the column of clay, the shear forces are relieved, and the springs 19 rebound and snap back toward the wall 17*a* of the slot 17 and into contact with the cushion pad or block 30. In the absence of the cushion block or pad 30, the free end portion 18 of the bow spring 19 would normally snap back into contact with the wall 17*a* of the slot 17 and thus over stress the cutting wire 24 with consequent damaging effect thereon. In this regard, in the conventional brick-cutting machine, without the present cushion blocks or pads 30, the cutting wires 24 are frequently broken by the sudden rebounding of the springs 19 following passage of the wires through the clay column, and breakage and subsequent replacement of the cutting wires 24 accounts for a major proportion of the "down" time for these machines. However, it has been found through actual operating conditions that the interposition of the cushion blocks or pads 30 substantially reduces cutter wire breakage and increases the normal operating life of the cutting wires by approximately tenfold.

Another advantage is that the present cushion blocks or pads 30 may be easily installed in an existing brick-cutting machine without disassembly or modification of any parts of the machine.

In view of the foregoing, it will be seen that the present invention provides a mechanically simple yet highly efficient means for reducing cutter wire breakage in rotary reel-type brick-cutting machines and thereby greatly increasing the operational time of such machines.

While a single, presently preferred embodiment of the invention has been illustrated and described in detail, it should be understood that various modifications in details of construction and design are possible without departing from the spirit of the invention or the scope of the following claims.

I claim:

1. In a brick-cutting machine having an axially rotatable reel which includes a multiplicity of axially rotatable inner hub plates, a plurality of axially extending, outer support bars disposed in radially outwardly spaced relation to said inner hub plates, and formed with a plurality of longitudinally spaced slots, a multiplicity of U-shaped bow springs carried by each of said support bars and having resiliently flexible free end portions extending through and movable within the slots formed in said bars, and a multiplicity of radially disposed cutting wires carried in tension between said hub plates and the resiliently flexible free end portions of said bow springs; that improvement which comprises a resiliently compressible cushion block carried in each of the slots of said outer support bars and arranged to limit rebounding movement of the free end portions of said springs within the slots of said support bars.

2. A brick cutting machine according to claim 1, wherein said cushion block is composed of vulcanized rubber and is formed at each end thereof with a V-shaped notch for interfiting engagement with said support bar adjacent each end of the slot in which said block is positioned.

* * * * *